United States Patent [19]

Ohno et al.

[11] Patent Number: 4,865,901

[45] Date of Patent: Sep. 12, 1989

[54] THERMAL TRANSFER PRINTING RIBBON

[75] Inventors: Hatsue Ohno, Nagoya; Mikio Imaeda, Bisai, both of Japan

[73] Assignee: Brother Kogyo Kabushiki Kaisha, Japan

[21] Appl. No.: 927,515

[22] Filed: Nov. 6, 1986

[30] Foreign Application Priority Data

Nov. 6, 1985 [JP] Japan ..... 60-249763
Feb. 3, 1986 [JP] Japan ..... 61-21748

[51] Int. Cl.[4] ..... B41M 5/26

[52] U.S. Cl. ..... 428/212; 428/195; 428/475.5; 428/480; 428/500; 428/522; 428/523; 428/532; 428/913; 428/914

[58] Field of Search ..... 428/195, 207, 211, 484, 428/488.1, 488.4, 913, 914, 212, 475.5, 480, 500, 522, 523, 532; 400/120, 241.1

[56] References Cited

U.S. PATENT DOCUMENTS 4,536,434 8/1985 Magnotta ..... 428/488.4
4,581,266 4/1986 Magnotta ..... 428/488.4
4,614,682 9/1986 Suzuki et al. ..... 428/488.4

*Primary Examiner*—Bruce H. Hess
*Attorney, Agent, or Firm*—Oliff & Berridge

[57] ABSTRACT

In accordance with the present invention, a thermal transfer printing ribbon has a support element, and an ink layer including a thermal melting ink which is a blend of a binder and a colorant, the binder having an ethylene-vinylacetate copolymer and a highly viscous resin which has a melt viscosity of $10^3$ to $5\times10^4$ P at 150° C. In accordance with other features of the present invention, a thermal transfer printing ribbon has a support element, and an ink layer which is a blend having a first component, a second component which is not soluble in the first component, and a colorant, the first component including at least one of either an ethylene-vinylacetate copolymer and ethylene-ethyl acrylate, the second component including a highly viscous resin whose melt viscosity is greater than $10^3$ P at 150° C.

8 Claims, 3 Drawing Sheets

THERMAL TRANSFER PRINTING RIBBON

TECHNICAL FIELD

The present invention relates to a ribbon to be used in thermal transfer printing.

BACKGROUND ART

In thermal transfer printing, the ribbon is contacted by a thermal print head to produce local heating of an area of the ribbon upon thermal activation of a thermal element of the thermal print head. Thus heat is selectively applied to portions of the ribbon to melt an ink layer contiguous to the element via a support element onto the paper being printed upon. Ink is transferred from the ribbon to the paper at the localized areas in which heat is generated.

The prior thermal transfer printing ribbon comprises a support member coated with meltable ink which includes a colorant and a binder which is made of wax primarily. Satisfactory printing quality in using a normal paper, however, can be achieved only if the Beck smoothness of the normal paper is several ten or more seconds. The heat meltable ink can not be contacted with a concavity of paper, and the ink can not be transferred sufficiently to the concavity due to the low smoothness of the paper as shown in FIG. 2 to thereby cause blurring and leaving out of printing. To solve the above-mentioned disadvantages, reduction of the ink melting viscosity or the penetration of the ink from a convexity contacted with the ink into the concavity not contacted with the ink, have been proposed and developed. Outlines of the transferred ink print, however, are blurred and blotted, because undesired flowing of the ink results in certain printed areas where the ink should not have been transferred.

Furthermore, during thermal transfer printing correction of an erroneously printed character, since the ink penetrates into the paper, only a method for covering up over the incorrect character by whiting (cover-wrap method) has been proposed, thus resulting in poor outward appearance.

SUMMARY OF THE INVENTION

A first object of the present invention is to provide a thermal transfer printing ribbon in which ink is applied clearly and completely upon a rough sheet of paper within the ability of the prior thermal head.

A second object of the present invention is to provide a thermal transfer printing ribbon in which the ink of a missspelled portion is removed from the paper by the thermal transfer printing ribbon during a lift-off correction.

A third object of the present invention is to provide a thermal transfer printing ribbon in which the adhesive force between a support layer and meltable ink is less than a film strength of the meltable ink.

A fourth object of the present invention is to provide a thermal transfer printing ribbon wherein the ink which has been transferred onto a rough sheet of paper can be clearly transferred from the sheet to the ribbon without tearing into pieces even if some portion of the ink has not been in contact with a concavity of the rough sheet.

A fifth object of the present invention is to provide a thermal transfer printing ribbon with a lift-off correction feature.

The sixth object of the present invention is to provide a thermal transfer printing ribbon in which the meltable ink has two components. One is transferred in a rate-determining process (heat melting, fluidity). The other is transferred without fluidity and the colorant contained in the second component never penetrates into the fibers of the printing paper.

In accordance with the present invention, a thermal transfer printing ribbon having a support element, and an ink layer including a thermal melting ink which is a blend of a binder and a colorant, the binder having ethylenevinylacetate copolymer and a high viscous resin which has a melt viscosity of $10^3$ to $5\times10^4$ P at 150° C. In accordance with the other features of the present invention, a thermal transfer printing ribbon having a support element, and an ink layer which is a blend having a first component, a second component which is not soluble in the first component, and a colorant, the first component including at least one of ethylene-vinyl acetate copolymer and ethylene-ethyl acrylate, the second component including a highly viscous resin whose melting viscosity is greater than $10^3$ P at 150° C.

According to the present invention, the meltable ink is melted by the heat of the thermal head at the contact area of the convexity of the paper and applied to adhere sufficiently. The cohesive force of the meltable ink itself is greater than the adhesive force between the support layer and the heat melt ink, thereby allowing transference from the ink portion to the corresponding concavity of the paper. Accordingly, since the cohesive force between he paper and the ink layer is only that of ethylene-vinylacetate copolymer, it is not so strong a force. The ink portion transferred onto paper comes into contact with unused portion of the ink ribbon while presenting almost the same energy as thermal transfer, thus enabling ink upon the paper to melt with ink upon the ribbon. When this melted portion is cooled down and the ribbon is pulled away from the paper, the abovementioned transferred ink is removed.

These and other objects along with the advantages of the invention will become apparent with reference to the following specifications, attendant claims, and drawings.

DETAILED DESCRIPTION OF THE PREFERRED EMBODIMENT

A first embodiment of the present invention is hereinafter described.

Figure 1:
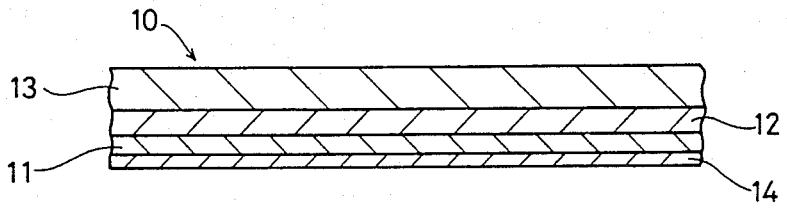
FIG. 1 is a cross sectional view illustrative of a thermal printing ribbon of one embodiment according to the present invention.

Referring to FIG. 1, a thermal printing ribbon 10 comprises a support element 11, a release layer 12 and an ink layer 13. The support element 11 is a heat resistant film which tolerates temperatures above or at 150° C. made of materials such as polyester, polyimide, polycarbonate, polysulfone, polyethersulfone, polyphenylene sulfide, polyether-ether ketone, or paper like condenser paper and glassine paper. The support layer has a thickness on the order of 3 to 20 microns. A layer 14 for preventing sticking made of heat-resistant resin such as silicon resin is provided upon a surface opposite to the surface coated with the ink layer 13 which is a blend of a binder and a colorant such as a pigment, for example, carbon black. Dyes are added for auxiliary aids for improvement of color tone. The binder is made such that the melting viscosity is higher and a cohesive force at the transference stage is stronger than those of the prior meltable ink layer 13. The binder is selected from at least one of binders comprising ethylenevinylacetate copolymer resin and a high viscous resin with the melting viscosity from $10^3$ to $5\times10^4$ P at 150° C. which is selected from at least one of vinylchloride-vinylacetate copolymer resin, vinylchloride-vinylacetate-polyvinyl alcohol copolymer resin, polyvinyl butyral, polyethylene oxide, polycaprolactone, acrylic resin, polystyrene, cellulose acetate, polyester, polyethylene, or ethyl cellulose. A wax-like material having the melting point of from 40° C. to 100° C., is blended in accordance with the desired melting point, the melting viscosity, printing quality. The wax-like material is selected from at least one of either paraffin wax, microcrystalline wax, paraffin wax oxide, candelira wax, carnauba wax, montan wax, ceresin wax, polyethylene wax, polyethylene oxide wax, Caster wax, fatty hardened oil of cattle, lanolin, Japan wax, sorbitan stearate, sorbitan palmitate, stearyl alcohol, polyamide wax, oleic amide acid, stearic amide, hydroxystearic acid, synthetic ester wax, or metal complex synthetic wax.

The release layer 12 is made of polyethylene wax whose melting point is from 80° C. to 120° C. It acts as a releasing means which releases the ink layer 13 from the support element 11. It should be noted that the release layer 12 may include a filler agent such as bentonite, kaoline, talc etc., in order to satisfy the requirements of an ink ribbon and improve the ink release characteristic.

The following is the description of the manufacturing process according to the present invention wherein the support element 11 having the layer 14 upon one side surface thereof, is coated with the release layer 12 and the ink layer 13.

(1) production (or formation procedure) of the release layer

Polyethylene wax emulsion is diluted with water to be the coating liquid. When the filler agent is added to the coating liquid, the filler filing agent is then dispersed into the coating liquid, using a dispersing machine such as three way roll mill, centry mill, sand mill, and ball mill.

(2) coating and drying procedure of the release layer

The support element, such as a polyester film of 3.5 microns thickness, is coated with the above-mentioned coating liquid using the coating device, and then dried at the range of from 80° C. to 100° C. In this embodiment the thickness of the release layer 12 is determined to be about 1 micron.

(3) manufacturing process of the meltable ink

The colorant, and the binder, which is a blend of an ethylene-vinyl acetate copolymer resin and a high viscosity resin having the melting viscosity of from $10^3$ to $5\times10^4$ P at 150° C., are melted together or dispersed into solvent the dispersing machine similar to the above-mentioned processing (1). This melted or dispersed liquid is used as ink liquid in the following procedure.

(4) coating and drying procedure of ink liquid

The support element 11, which has been coated with the release layer 12, is further coated with the above-mentioned ink liquid by a coating device. Then the ink liquid is dried at a temperature between 80° C. to 100° C. to become the ink layer 13 whose thickness is 4–6 microns, and finally the thermal printing ribbon 10 is formed as shown in FIG. 1.

Two examples of the invention will be illustrated hereinafter.

EXAMPLE 1

| | |
|---|---|
| A. release layer | |
| a. release layer component | 1 part |
| polyethylene wax emulsion | 100 wt % |
| [CHUKYO YUSHI K.K ME-100] | |
| B. meltable ink layer | |
| b. ink component | 1 part |
| ethylene-vinyl acetate copolymer | 45 wt % |
| [MITSUI-DUPONT POLYCHEMICAL CO., LTD EVAFLEX 420 38.5 wt %] | |
| [MITSUI-DUPONT POLYCHEMICAL CO., LTD EVAFLEX 220 6.5 wt %] | |
| vinyl chloride-vinyl acetate copolymer | 25 wt % |
| [SEKISUI CHEMICAL CO., LTD S-LEC C] | |
| polyethylene oxide wax | 10 wt % |
| [SANYO CHEMICAL INDUSTRIES, LTD SAN WAX E-300] | |
| carbon black | 20 wt % |
| [MITSUBISHI CHEMICAL INDUSTRIES LTD. MA-100] | |
| total | 100 wt % |
| c. solvent | 4 parts |
| methyl isobutyl ketone | 100 wt % |

A coating liquid made from the above-mentioned component (a) is applied upon the support element 11 which is a polyester film of a thickness of 3.5 microns, thereby forming the release layer 12 of a thickness of 1 micron over the film. Thereafter, the ink coating liquid made from the component (b) and the component (c) is applied on the release layer 12, and then dried at a temperature of 80°–100° C., thereby forming the ink layer 13 of a thickness of 4–6 microns over the release layer 12. By means of the thermal printing ribbon 10 manufactured in this manner, thermal printing was executed on the paper whose Beck smoothness is about 3 to 4 seconds. More particularly, the ink was transferred into the concavity on the paper, thereby resulting in sharp and thick printed images without blur.

Figure 2:
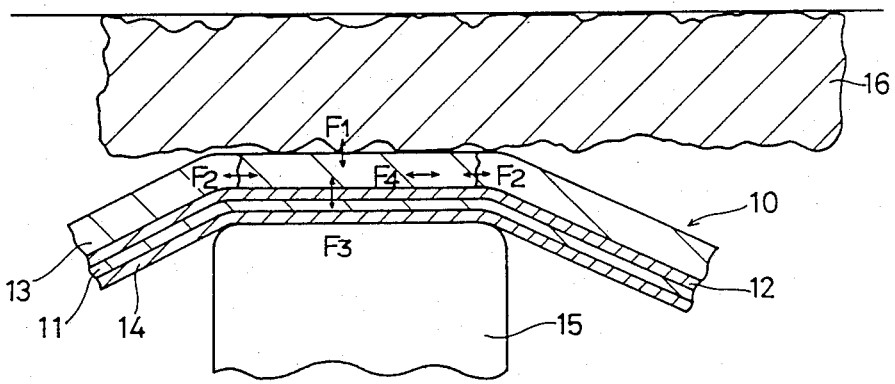
FIG. 2 is a cross sectional view illustrative of the thermal printing ribbon during transfer operation.
Figure 3:
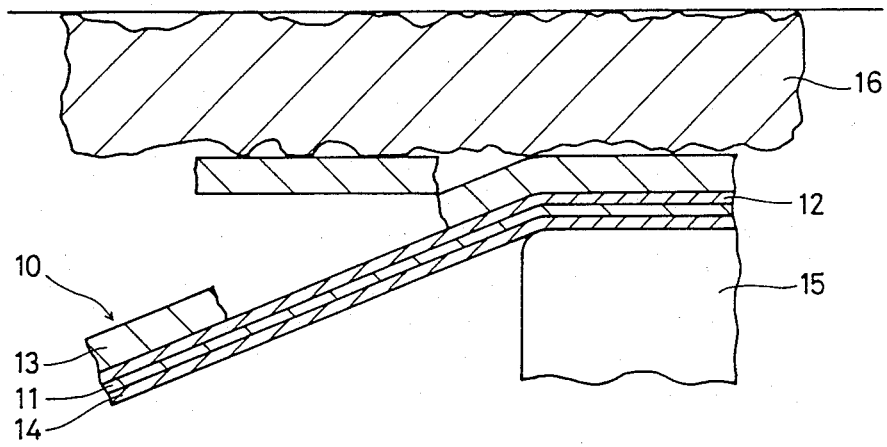
FIG. 3 is a cross sectional view illustrative of a printing paper and a thermal printing ribbon after printing.

FIGS. 2 and 3 illustrate the ink transfer mechanism using the thermal printing ribbon 10 of this invention in case that ink is transferred onto a paper of low smoothness.

A thermal head 15 presses the ribbon 10 into close contact with printing paper 16 upon a platen (not shown). Upon thermal energization of the thermal head 15, the intensive local heat thus produced is transmitted onto the layer 14 for preventing sticking, the support element 11, the release layer 12, and the ink layer 13. As a result of the transmission heat the release layer 12 and the ink layer 13 are melted, and the meltable ink is adhered onto the concavity of the paper. In the prior art comprising mainly wax and the like, ink partially permeates into the printing paper 16. In the present embodiment, such permeation never occurs because a thermoplastic resin, which has a greater melting viscosity than prior art, is used. When the thermal head 15 is inactivated, the ink layer 13 is cooled down, and adheres onto the printing paper 16. In this stage, the heated areas of the release layer 12 still remains in the liquid state. The ink layer 13 corresponding to the heated areas of the release layer 12 have intensive internal cohesive force, while the weak adhesive force between the ink layer 13 and the release layer 12, is much smaller than the adhesive force between the unheated ink layer 12 and the release layer 12. Referring to FIG. 3, every portion of the heated ink layer, which will correspond to the printed images, can be easily transferred onto the uneven printing paper 16 even if some portion of the heated ink layer 13 does not come into contact with the concavity of the paper 16. In this state, the following relationship is effected.

$$F4 >> F1 > F2 > F3$$

where F1 is adhesive force of the ink layer 13 onto the printing paper 16, F2 is the cohesive force of the ink layer 13 at a boundary between a heated area and a non-heated area, F3 is the adhesive force between the ink layer 13 and the release layer 12, or between the release layer 12 and the support element 11, F4 is the cohesive force of a heated area of the ink layer 13.

As can be seen, it is possible to print clearly without blur by means of the above-mentioned force F4 and the above-mentioned weak force F3 between the release layer 12 and the support element 11.

Figure 4:
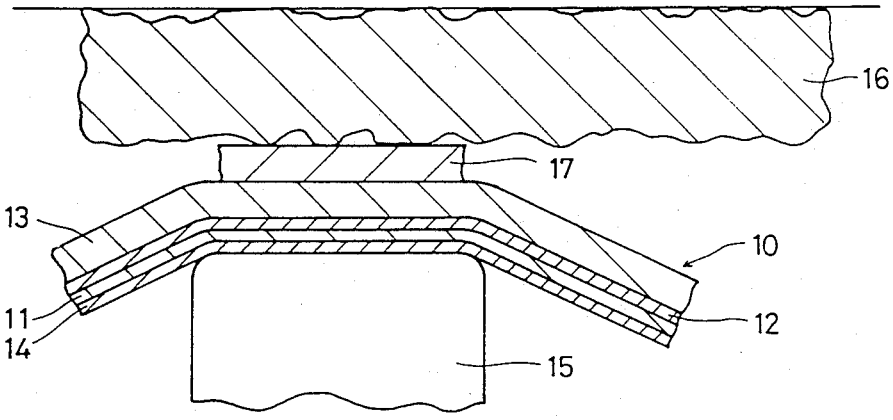
FIG. 4 is a cross sectional view illustrative of an erasure operation.
Figure 5:
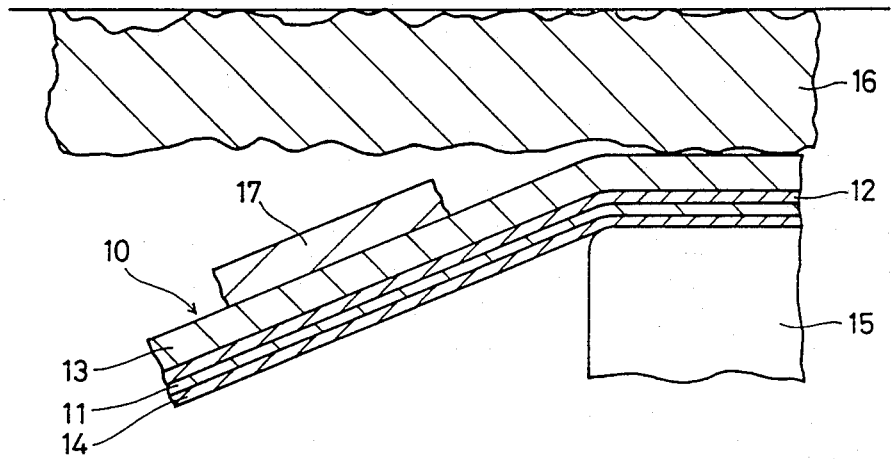
FIG. 5 is a cross sectional view illustrative of print paper and a thermal printing ribbon after an erasure operation.

FIGS. 4 and 5 illustrate a mechanism of lift-off correction using thermal printing ribbon 10 according to the present embodiment.

During the erasure operation, the ribbon 10 is held in firm contact by thermal hesd 15 with the ink portion 17 corresponding to the incorrect character upon the printing paper 16 which is mounted on a platen (not shown). When the thermal head 15 is energized, the release layer 12, the ink layer 13, and the ink portion 17 corresponding to the incorrect character are heated through both the layer 14 and the support element 11 to thereby melt the above-mentioned three. When the thermal head 15 is inactivated, the above-mentioned three are cooled down, and the above-mentioned ink layer 13 and the ink portion 17 adhere firmly to each other after a predetermined time interval. At this time, the adhesive force applied between the printing paper 16 and the ink portion 17 is smaller than that between the support element 11 and the release layer 12, than that between the release layer 12 and the ink layer 13, and than that between the ink layer 13 and the ink portion 17. In this state, when the thermal printing ribbon 10 is pulled away from the printing paper 16 of FIG. 5, the ink 17 upon the incorrect character an the printing paper 16 is removed clearly from the paper 16 together with the ribbon 10.

EXAMPLE 2

| | |
|---|---|
| A. the release layer | |
| a. the release layer component | 1 part |
| polyethylene wax emulsion | 100 wt % |
| [CHUKYO YUSHI K.K ME-10] | |
| B. meltable ink layer | |
| b. ink component | 1 part |
| ethylene-vinyl acetate copolymer | 45 wt % |
| [MITSUI-DUPONT POLYCHEMICAL CO., LTD EVAFLEX 420 42.5 wt %] | |
| [MITSUI-DUPONT POLYCHEMICAL CO., LTD EVAFLEX 450 7.5 wt %] | |
| vinyl chloride-vinyl acetate copolymer | 30 wt % |

-continued

| | |
|---|---|
| [SEKISUI CHEMICAL CO., LTD S-LEC C5] | |
| polyethylene oxide wax | 5 wt % |
| [SANYO CHEMICAL INDUSTRIES, LTD SAN WAX E-250P] | |
| carbon black | 15 wt % |
| [MITSUBISHI CHEMICAL INDUSTRIES LTD. MA-100] | |
| | total 100 wt % |
| c. solvent | 4 parts |
| methyl isobutyl ketone | 50 wt % |
| toluene | 50 wt % |
| | total 100 wt % |

Using this thermal printing ribbon 10, made from these components through the same process as Example 1 the same printing quality as the example 1 has been achieved.

The characteristics of the ink comprising the release layer (undercoat) and the ink layer (topcoat) during transference and lift-off correction are more specifically described. A release period is a time interval from a time when the ribbon is heated by the thermal head to a time when the ribbon is pulled from the paper. Since the release period of lift-off correction is longer than that of transference, the ink is released with relatively low temperature, i.e., cooled condition in correction, compared with the case in transference.

Since to the release layer is mainly made from polyethylene wax, its melting viscosity sharply drops, in response to the rise of temperature resulting in obvious decreased in its adhesive force to the support layer relative to its adhesive force to the ink layer. The ink is thus released from the support layer to be transferred to the paper in transference. In correcting, the release layer being cooled down, the wax contained therein gets solidified, resulting in firm adhesion between the ink and the support layer. Accordingly, the stickiness between the ink and the support layer is greater than that between the ink and the paper, the ink is thereby released from the paper along with the erroneously typed ink portion.

The basic components of the ink layer are ethylene-vinyl acetate copolymer and highly viscous resin. According to the ink characteristic, the rise in temperature causes the drop in melting viscosity, while the ink keeps viscosity and cohesion without high fluidity featured in the wax.

In thermal transference, since the ink becomes to be melted, only heated area is likely to be torn off from the ribbon, because of strong ink viscosity against the paper and small cohesion per se. In correcting the ink becomes to be cooled down and gets solidified so that it is released from the paper because of smaller ink viscosity against the paper and great cohesion (including the mis-spelled area added to the ink ribbon). As aforementioned, the combination of the characteristics of both the ink layer and the release layer enables to achieve transference and erasing.

A second embodiment is hereinafter described. Referring to FIG. 1, a thermal printing ribbon 10 comprises a support element 11, a release layer 12 and an ink layer 13. More specifically, the support element 11 is a heat-resistant film tolerating temperatures above 150° C. made of materials such as polyester, polyimide, polycarbonate, polysulfone, polyethersulfone, polyphenylene sulfide, polyether-ether ketone, or paper like condenser paper and glassine paper. The support layer has a thickness on the order of 3 to 20 microns. A layer 14 for preventing sticking made of heat resistive resin such as silicon resin is provided upon a surface opposite to the surface coated with the ink layer 13 which is a blend of a binder and a colorant such as a pigment, for example, carbon black. Dyes are added for auxiliary aids for improvement of color tone. The binder is made such that the melting viscosity is made higher and a cohesive force at transferring stage is made stronger than those of the prior meltable ink layer 13. In order to ensure good transferability to unsmooth paper and good lift-off correction, the binder has a first component including at least one of either ethylene-vinyl acetate copolymer and ethylene-ethyl acrylate, a second component which is not soluble with the first component and which includes a highly viscous resin whose melt viscosity is greater than $10^3$ P at 150° C. The first component has a MI value of from 50 to 500 at 160° C. and a softening point of from 80° to 140° in response to the requirement. If the first component is blended with the colorant, printing quality and the lift-off correction are not sufficient. These have been achieved by blending the first component with the second component containing the colorant.

The second component is selected from the limited materials which have a heat resistant characteristic and a fluidity characteristic, pigment dispersion characteristic, and a film forming characteristic etc., on the assumption that the second component is not dissolved with the first component and is limited thereto.

In the case that a polybutyral resin is used as the second component, it does not satisfy the affinity for colorants such as carbon black or good dispersion. However, the ideal ink has been obtained if a vinylchloride-vinylacetate-vinylalcohol copolymer is used together with the above-mentioned polybutyral resin. On the other hand polyethylene oxide used as the second component causes a condition similar to the above-mentioned case where butyral resin is used, and it is effective to use polyethylene oxide together with the above-mentioned vinylchloride-vinylacetate. It should be noted that a water solvent system can be applied instead of the above-mentioned solvent system, wherein polyvinyl alcohol as the second component is provided with the colorant which is dispersed therein and then blended with, then an emulsion of the first component, thereafter producing the desired ink.

The improvement of the first component is hereinafter described. To correspond to the printing conditions such as activation of the thermal head and pressure duets the thermal head, and the like it is effective to add a wax which is soluble with the first component and has a melting point from 60° C. to 120° C. Specifically, the wax is selected from a group consisting of paraffin wax, microcrystalline wax, paraffin wax oxide, canderila wax, carnauba wax, montan wax, ceresin wax, polyethylene oxide wax, polyethylene wax, Caster wax, fatty hardened oil of cattle, lanolin, Japan wax, sorbitan stearate, sorbitan palmitate, stearyl alcohol, polyamide wax, oleic amide, stearic acid, hydroxystearic acid, synthetic ester wax, and metal complexed synthetic wax.

The release layer 12 is made of polyethylene wax whose melting point is from 80° C. to 120° C., and which adheres weakly the support element 11. It should be noted that the release layer 12 may include a filler agent such as bentonite, kaoline, talc etc., in order to satisfy the requirements of an ink ribbon and improve the ink release characteristic.

The foregoing ink ribbon with the ink layer and release agent usually achieving good thermal transfer and lift-off correction under any conditions. However, under particular conditions these performances can not be attained. To solve this problem, it is effective to coat the ink layer with an overcoat which improves the printing quality and lift-off correction in a case rough paper is used. It is also especially preferable that the overcoated layer comprises a resin similar to the first component which has no colorant. The reasons for the aforementioned improvement, as a result of the overcoat layer will be described as follows.

The overcoat layer does not contain the powder which adsorbs much oil like carbon black contained in the ink layer, thereby heightening adhesion to the paper during thermal activation and improving the transferring performance. Since the overcoat layer is transparent, it is invisible even if a slight amount of the layer is left on the paper due to incomplete lift off. Since the overcoat layer does not contain the powder which adsorbs much oil, it is able to form continuous and even film, thereby preventing some portion of the film from being torn off and left on the paper during lift off correction.

The following is a description about the reason that the second component should not dissolve with the first component.

The necessity of adding the second component to the first component is hereinafter described. The transferred ink portion is clearly torn off from the non-transferred ink portion during transfer, and the cohesion of the ink to the paper and the film intensity of the ink are adjusted to improve transfer and lift off performances.

In case the first and second components dissolved in each other, the heat resistance of the ink is remarkably increased because the second component has higher heat resistance than state of the first component. Thus, the effect of heat sensing transference is deteriorated. The facility in releasing of the ink described above is not improved in this case.

In case that the first and second components do not dissolve in each other, the second component exists on the surface made from precipitation particles of the first component so that to the above-mentioned facility in releasing the ink is greatly improved with only a small amount of ink without having the effect of the heat sensing transference of the first component itself. Therefore, if the second component which does not dissolve in the first component is added to the first component the above-mentioned objects can be achieved without deteriorating the effect of heat sensing transference of the ink.

The following is the description of the manufacturing process according to the present invention wherein the support element 11 having the layer 14 upon one side surface thereof, is coated with the release layer 12 and the ink layer 13.

(1) formation procedure of the release layer

Polyethylene wax emulsion is diluted with water to be the coating liquid. When the filler agent is added to the coating liquid, the filler agent is dispersed into the coating liquid, using a dispersing machine such as three way roll mill, centry mill, sand mill, and ball mill.

(2) coating and drying procedure of the release layer

The support element 11 such as a polyester film of thickness of 3.5 microns, is coated with the above-mentioned coating liquid with the coating device, then dried at the range of 80° C.–100° C. In this embodiment the coating is applied to a 1 micron thickness.

(3) manufacturing procedure of the meltable ink

Ethylene-vinylacetate copolymer or ethyleneethyleneacrylate copolymer is dissolved into a solvent and heated, and then cooled down to the extent that the resin precipitated. Separately, a high viscosity resin which is not soluble with the above-mentioned resin and has the melting viscosity above $10^3$ at 150° C., is dissolved and blended with the colorant.

The above-mentioned two solutions are dispersed in each other by using the dispersing machine as used in the above-mentioned processing (1). This dispersed liquid is used as ink liquid in the following procedure.

(4) coating and drying procedure of ink liquid

The above-mentioned ink liquid is applied upon the support element 11, which has been coated with the release layer 12, by a coating device, and then dried at 80° to 100° C. In this embodiment, the thickness of the ink layer 13 is determined to be between 4 and 6 microns. Through the aforementioned processes, the thermal printing ribbon 10 is obtained as shown in FIG. 1.

EXAMPLE 3

| | |
|---|---|
| A. release layer | |
| a. release layer component | |
| polyethylene wax emulsion | 100 wt % |
| [CHUKYO YUSHI K.K ME-100] | |
| (concentration of solid component 32%) | |
| B. meltable ink layer | |
| b. ink component | 1 part |
| ethylene-vinyl acetate copolymer | 63 wt % |
| [MITSUI-DUPONT POLYCHEMICAL CO., LTD EVAFLEX 310 48 wt %] | |
| [MITSUI-DUPONT POLYCHEMICAL CO., LTD EVAFLEX 360 15 wt %] | |
| vinyl chloride-vinylacetate-polyvinylalcohol copolymer | 5 wt % |
| [SEKISUI CHEMICAL CO., LTD S-LEC A] | |
| polyvinylbutyral resin | 15 wt % |
| [SEKISUI CHEMICAL CO., LTD S-LEC BMS] | |
| polyethylene wax | 5 wt % |
| [SANYO CHEMICAL INDUSTRIES, LTD SAN WAX E-300] | |
| carbon black | 12 wt % |
| [MITSUBISHI CHEMICAL INDUSTRIES LTD. MA-100] | |
| total | 100 wt % |
| c. solvent | 5 parts |
| methyl isobutyl ketone | 100 wt % |

A coating liquid made from the above-mentioned component (a) is applied upon the support element 11 which is a polyester film of a thickness of 3.5 microns, thereby forming the release layer 12 of a thickness of 1 micron over the film. Thereafter, the ink coating liquid made from the component (b) and the component (c) is applied on the release layer 12, and then dried at a temperature of 80°–100° C., thereby forming the ink layer 13 of a thickness of 4–6 microns over the release layer 12. By means of the thermal printing ribbon 10 manufactured in this method, thermal printing was executed on the paper whose Beck smoothness is about 3 to 4 seconds. More particularly, the ink was transferred into the concavity on the paper, thereby resulting in sharp and thick printed images without blur.

FIGS. 2 and 3 illustrate the ink transfer mechanism using the thermal printing ribbon 10 of this invention in case that ink is transferred onto a paper of low smoothness. A thermal head 15 presses the ribbon 10 into close contact with print paper 16 upon a platen (not shown). Upon activation of the thermal head 15, intensive local heat thus provided is transmitted onto the layer 14, the support element 11, the release layer 12, and the ink layer 13. As a result of the transmission of heat the release layer 12 and the ink layer 13 are melted, and the meltable ink is adhered onto the convexity of the paper. In the prior art comprising mainly wax and the like, ink partially permeates into the fibers of the printing paper 16. In the present embodiment, such permeation never occurs because a thermoplastic resin, which has a greater melting viscosity than prior art, is used. When the thermal head 15 is inactivated and heat generation thereof is terminated, the ink layer 13 and the release layer 12 are cooled down. In this stage (The above-mentioned two cooled layers 12 and 13 are imperfectly cooled and semi-solid), when the thermal printing ribbon is pulled away from the paper 16, semi-solid ink transfers onto the paper 16, as begun from a contact point between ink and paper 16. In this state, the following relationship is effected.

$$F4, F1 > F2 > F3$$

where F1 is adhesive force between the ink layer 13 and the printing paper 16,

F2 is the film strength of the ink layer 13 at boundary surface between a heated area and a non-heated area,

F3 is the adhesive force between the ink layer 13 and the release layer 12, or between the release layer 12 and the support element 11,

F4 is the film strength of a heated area of the ink layer 13.

As can be seen, using the above-mentioned force F4 and the above-mentioned weak force F3 between the release layer 12 and the support element 11, the high print quality in which blurred and irregular print is prevented, has been achieved.

FIGS. 4 and 5 illustrate a mechanism of lift-off correction using the thermal printing ribbon 10 according to the present embodiment. The description is omitted, because the content is identical to the above-mentioned first embodiment.

While preferred embodiments of the invention have been described using specific terms such description is for illustration only, and it is to be understood that changes and variations may be made without departing from the spirit or scope of the following claims.

What is claimed is:

1. A thermal transfer printing ribbon for printing on a print-receiving material, the ribbon comprising:

a support element, and an ink layer including a thermal melting ink which is a blend comprising a binder and a colorant, said binder comprising ethylene-vinylacetate copolymer and a highly viscous resin which has a melt viscosity of $10^3$ to $5\times10^4$ P at 150° C. to provide clear printing of said ink on the print-receiving material and clear correction of typing mistakes by removing said ink from the print-receiving material.

2. The thermal transfer printing ribbon according to claim 1 wherein the highly viscous resin has a high affinity with said colorant and a high dispersion characteristic.

3. The thermal transfer printing ribbon according to claim 2 wherein said highly viscous resin comprises at least one material selected from the group consisting of vinylchloride-vinylacetate copolymer, vinyl chloride-vinylacetate-polyvinyl alcohol copolymer, polyvinyl butyral, polyethylene oxide, polycaprolactone, acrylic resin, polystyrene, cellulose acetate, polyester, polyethylene, and ethyl cellulose.

4. The thermal transfer printing ribbon according to claim 1 further comprising a prevention layer for preventing sticking, said prevention layer contacting the support element on a side of the support element opposite to said ink layer.

5. The thermal transfer printing ribbon of claim 1 further comprising a release layer between said support element and ink layer, the release layer releasing from said ink layer during printing and remaining in contact with said ink layer during correction.

6. A thermal transfer printing ribbon for printing on a print-receiving material, the ribbon comprising:

a support element, and an ink layer which is a blend comprising a first component, a second component which is not soluble in said first component, and a colorant, said first component including at least one of ethylene-vinyl acetate copolymer and ethylene-ethyl acrylate, said second component including a highly viscous resin whose melt viscosity is greater than $10^3$ P at 150° C. to provide clear printing of said ink on the print-receiving material and clear correction of typing mistakes by removing said ink from the print-receiving material.

7. The thermal transfer printing ribbon according to claim 6 wherein said second component is selected from at least one of polyvinyl butyral, vinylchloride-vinylacetate copolymer, vinylchloride-vinylacetate-vinylalcohol copolymer, polyethylene oxide, polyvinyl alcohol, polycaprolactone, polyester, polyethylene, cellulose nitrate, and cellulose acetate.

8. The thermal transfer printing ribbon according to claim 7 wherein an overcoat layer is provided upon said ink layer, and has the same composition as said first component without the colorant.

* * * * *